US011611825B2

(12) United States Patent
Yu

(10) Patent No.: US 11,611,825 B2
(45) Date of Patent: Mar. 21, 2023

(54) AUDIO SIGNAL PROCESSING METHOD AND APPARATUS

(71) Applicant: ZTE CORPORATION, Guangdong (CN)

(72) Inventor: Bing Yu, Guangdong (CN)

(73) Assignee: ZTE Corporation, Guangdong (CN)

( * ) Notice: Subject to any disclaimer, the term of this patent is extended or adjusted under 35 U.S.C. 154(b) by 0 days.

(21) Appl. No.: 17/273,000

(22) PCT Filed: Aug. 13, 2019

(86) PCT No.: PCT/CN2019/100431
§ 371 (c)(1),
(2) Date: Mar. 3, 2021

(87) PCT Pub. No.: WO2020/048298
PCT Pub. Date: Mar. 12, 2020

(65) Prior Publication Data

US 2021/0329377 A1 Oct. 21, 2021

(30) Foreign Application Priority Data

Sep. 7, 2018 (CN) ..... 201811045588.7

(51) Int. Cl.
*H04R 3/00* (2006.01)

(52) U.S. Cl.
CPC ..... *H04R 3/00* (2013.01); *H04R 2420/03* (2013.01); *H04R 2420/05* (2013.01); *H04R 2499/11* (2013.01)

(58) Field of Classification Search
CPC .. H04R 3/00; H04R 2420/03; H04R 2420/05; H04R 2499/11; H04R 5/04
USPC ..... 381/77–85, 74, 123
See application file for complete search history.

(56) References Cited

U.S. PATENT DOCUMENTS

| | | | | |
|---|---|---|---|---|
| 9,955,272 | B2 * | 4/2018 | Taylor | H04R 29/001 |
| 10,277,972 | B2 * | 4/2019 | Liu | H04R 1/1041 |
| 10,779,097 | B2 * | 9/2020 | Taylor | H01R 24/58 |
| 2016/0246747 | A1 * | 8/2016 | Rand | G06F 13/122 |
| 2017/0277650 | A1 * | 9/2017 | Zhao | G06F 13/385 |

OTHER PUBLICATIONS

Co-Pending EP Application No. 19858538.2, EP Extended Search Report dated May 2, 2022, 8 pages.

(Continued)

*Primary Examiner* — Disler Paul
(74) *Attorney, Agent, or Firm* — Perkins Coie LLP

(57) ABSTRACT

The present invention relates to the technical field of mobile terminals. Disclosed are an audio signal processing method and apparatus, a device, and a storage medium. The method comprises: when detecting that 3.5 mm earphones are connected by means of a type-C plug of a transfer cable, a mobile terminal determines whether states of audio channels of an audio ground GND and a microphone MIC of the type-C plug are correct. When determining that the states of the audio channels of the GND and the MIC of the type-C plug are correct, the mobile terminal decides whether to enter an audio mode. If the mobile terminal decides to enter the audio mode, a low-resistance network for reducing channel impedance is controlled to connect in parallel to the GND.

5 Claims, 4 Drawing Sheets

(56) References Cited

OTHER PUBLICATIONS

USB 3.0 Promoter Group "Universal Serial Bus Type-C Cable and Connector Specification, Release 1.3" Jul. 14, 2017, XP055591780, 241 pages.
Texas Instruments: "TS3A227E—Autonomous Audio Accessory Detection and Configuration Switch", Feb. 1, 2015, XP055913471, 61 pages.

* cited by examiner

AUDIO SIGNAL PROCESSING METHOD AND APPARATUS

CROSS-REFERENCE TO RELATED APPLICATIONS

This application claims the priority to the Chinese patent application CN201811045588.7 entitled "Audio signal processing method, device, apparatus, and storage medium" filed on Sep. 7, 2018, the entire content of which is incorporated herein by reference.

FIELD OF THE INVENTION

The present disclosure relates to the technical field of mobile terminals, and in particular to an audio signal processing method and apparatus.

BACKGROUND OF THE INVENTION

In recent years, a trend in smartphones is that mobile phones are becoming thinner and thinner, and requirements for waterproofness are getting higher and higher. In order to meet these requirements at the same time, the 3.5 mm earphone jack on many mobile phone products is replaced with a type-C earphone jack which is more conducive to the design of thickness of the entire mobile phone and the design of waterproofness. The type-C earphone jack is used as an audio earphone jack and a charging/USB data interface.

In the case of a mobile phone with a type-C earphone jack, an analog earphone with the type-C interface can be used, or a currently popular 3.5 mm earphone can be used by means of an adapter cable. As seen from the popularity of earphones in the mobile phone market and users' habits, most earphones are 3.5 mm earphones, and there are very few analog earphones with the type-C interface. With respect to the professional audio testing, interfaces on all testing apparatuses are also for 3.5 mm earphones. 3.5 mm earphones will therefore still be used by users and in professional tests for a long time. Thus a special adapter cable has to be added in order to convert audio signals transmitted on a type-C jack to signals for a 3.5 mm earphone.

Since the most important function of a mobile phone is wireless communication, the strong electromagnetic wave radiation of its radio transceiver circuit can cause the HiFi effect and even the effect of ordinary audio decoding output to sharply deteriorate. In order to reduce electromagnetic compatibility (EMC), it often requires a good shield ground. The way to deal with an analog ground (AGND), a digital ground (DGND), and a shield ground of a earphone directly affects crosstalk which is an important audio indicator.

There are currently two ways of hardware connection to realize a type-C analog earphone function: one is to use an analog earphone with a type-C plug, which can be directly plugged into a mobile phone; and the other is to use an adapter cable, which converts a type-C socket to a 3.5 mm earphone socket for a 3.5 mm earphone to plug in.

Audio interfaces for the above two ways of hardware connection however have serious technical defects.

Before the emergence of type-C analog earphones, all mobile phones or terminals used a earphone with a 3.5 mm plug, in which case crosstalk could reach −75 db or more, while for a mobile phone or terminal for a new analog earphone with a type-C plug, crosstalk can only reach about −30 db.

When testing is performed in the case that an adapter cable is used, the indicator of crosstalk is seriously affected by the adapter cable for the following three reasons.

1. A 3.5 mm socket is relatively far away from an input of a mobile phone or terminal, which increases impedance of an AGND.

2. The AGND is connected to the GND of the mobile phone or terminal by means of a type-C interface signal line. The signal line network is SBU1 or SBU2. Very small line widths of these two lines lead to increased impedance.

3. When the AGND is connected to a type-C plug and a type-C socket, the contact impedance of a pin on the type-C is also large.

In order to solve the above three design problems, there is such a technical solution in which an AGND of a earphone, a shield ground of an adapter, and a DGND in a type-C interface network are combined together. This solution improves the indicator of crosstalk. However, after the AGND is connected to the DGND, the position of the AGND at the 3.5 mm socket is fixed, which means that European and American standard earphones could not be automatically recognized and supported. This sacrifices the original technical advantages of a type-C earphone and harms user experiences.

After the emergence of type-C analog earphones, since the audio interface and the charging interface share a same place, there is a demand for charging while listening to music. This requires an adapter cable that simultaneously converts the type-C interface to a 3.5 mm earphone jack and a type-C charging port. Such an adapter cable has two branches: a branch for the earphone and the other branch for charging. In this way, if the AGND of the earphone, the shield ground of the adapter, and the DGND of the type-C port are combined together in accordance with the existing technical solution, it will not solve the problem of not being able to recognize European or American standard earphones, and meanwhile due to the combination of the DGND used by the charging branch and the AGND used by the audio branch, reflux noise produced from the charging can be introduced into the audio system, leading to significant deterioration of the indicator for noise level.

SUMMARY OF THE INVENTION

Technical solutions provided according to embodiments of the present disclosure solve the problem of a bad crosstalk indicator of type-C analog earphones.

An audio signal processing method according to an embodiment of the present disclosure includes the following steps.

When detecting that a 3.5 mm earphone is connected by means of a type-C plug of an adapter cable, a mobile terminal determines whether states of audio channels of an audio ground (GND) and a microphone (MIC) of the type-C plug are correct.

When determining that the states of the audio channels of the GND and the MIC of the type-C plug are correct, the mobile terminal decides whether to enter an audio mode.

If deciding to enter the audio mode, the mobile terminal controls a low-resistance network for reducing channel impedance to connect in parallel to the GND.

An audio signal processing method according to an embodiment of the present disclosure includes the following steps.

After an adapter cable is connected to a mobile terminal, it is detected whether a third control instruction used by the mobile terminal to control a third switch switching circuit is received.

When it is detected that the third control instruction used by the mobile terminal to control the third switch switching circuit is received, the adapter cable connects an adapter cable-side low-resistance network and an adapter cable-side type-C plug shell in an intermediate low-resistance network in parallel to a GND.

An audio signal processing apparatus according to an embodiment of the present disclosure includes a processor and a memory coupled to the processor. The memory stores thereon an audio signal processing program executable by the processor. When executed by the processor, the audio signal processing program implements steps of the audio signal processing methods according to the embodiments of the present disclosure.

The solutions provided by the embodiments of the present disclosure solves the problem of a bad crosstalk indicator of a type-C analog earphone by adding three switch switching circuits and a low-resistance network for reducing channel impedance, and thus improve user experiences.

DETAILED DESCRIPTION OF THE EMBODIMENTS

Preferred embodiments of the present disclosure will be described in detail below with reference to the accompanying drawings. It shall be appreciated that the preferred embodiments described below are only used to illustrate and explain, rather than limiting, the present disclosure.

Figure 1:
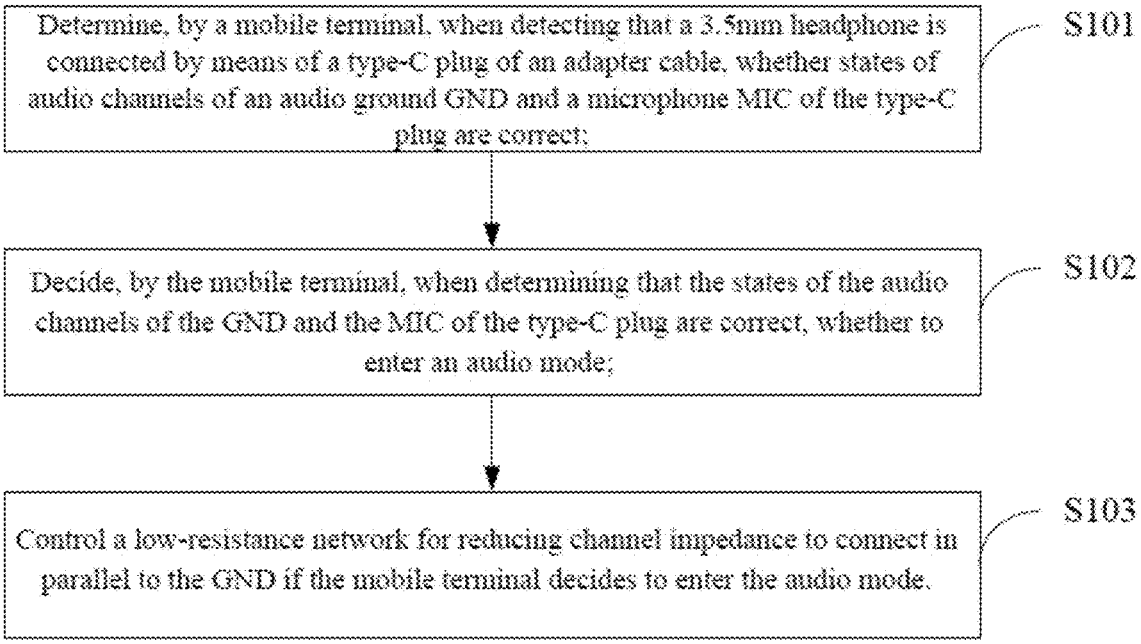
FIG. 1 is a flowchart of an audio signal processing method according to an embodiment of the present disclosure.

FIG. 1 is a flowchart of an audio signal processing method provided by an embodiment of the present disclosure. As shown in FIG. 1, the audio signal processing method includes the following steps.

In step S101, when detecting that a 3.5 mm earphone is connected by means of a type-C plug of an adapter cable, a mobile terminal determines whether states of audio channels of an audio ground (GND) and a microphone (MIC) of the type-C plug are correct.

Step S101 includes the following steps. An audio codec chip of the mobile terminal detects impedance of the GND and the MIC of the type-C plug through an audio ground signal line SBU1 and a microphone signal line SBU2, and decides whether the impedance of the GND and the MIC of the type-C plug meets a preset impedance value. When deciding that the impedance of the GND and the MIC of the type-C plug meets the preset impedance value, the mobile terminal determines that the states of the audio channels of the GND and the MIC of the type-C plug are correct. When deciding that the impedance of the GND and the MIC of the type-C plug do not meet the preset impedance value, the mobile terminal determines that the states of the audio channels of the GND and the MIC of the type-C plug are wrong.

The present embodiment further includes the following steps. When the mobile terminal determines that the states of the audio channels of the GND and the MIC of the type-C plug are wrong, a first switching instruction for controlling the type-C plug is generated. The mobile terminal, according to the first switching instruction, switches the GND and the MIC of the type-C plug by controlling a first switch switching circuit, so that the impedance of the GND and the MIC of the type-C plug meets the preset impedance value.

In step S102, when determining that the states of the audio channels of the GND and the MIC of the type-C plug are correct, the mobile terminal decides whether to enter an audio mode.

In step S103, if deciding to enter the audio mode, the mobile terminal controls a low-resistance network for reducing channel impedance to connect in parallel to the GND.

Figure 3:
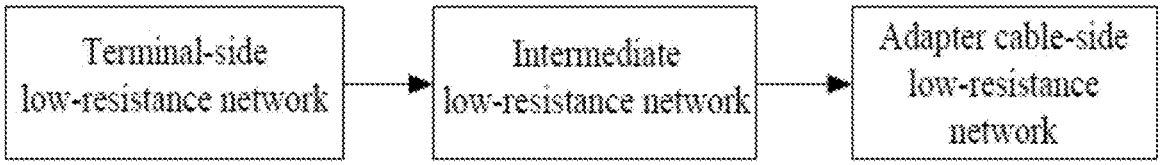
FIG. 3 is a schematic diagram of a structure of a low-resistance network according to an embodiment of the present disclosure.

As shown in FIG. 3, the low-resistance network includes a terminal-side low-resistance network, an intermediate low-resistance network, and an adapter cable-side low-resistance network. The terminal-side low-resistance network is an ultra-wide trace on a printed circuit board on a terminal side or a low-resistance wire with a low resistivity and a large diameter on the terminal side. The intermediate low-resistance network is a terminal-side type-C socket shell and an adapter cable-side type-C plug shell. The adapter cable-side low-resistance network is an ultra-wide trace on a printed circuit board on an adapter cable side or is a low-resistance wire with a low resistivity and a large diameter on the adapter cable side.

Step S103 includes the following steps. When the mobile terminal decides to enter the audio mode, a second control instruction for controlling the terminal side and a third control instruction for controlling the adapter cable side are generated, respectively. The mobile terminal connects, according to the second control instruction, the terminal-side low-resistance network and the terminal-side type-C socket shell in the intermediate low-resistance network in parallel to the GND by controlling a second switch switching circuit on the terminal side, and meanwhile, connects, according to the third control instruction, the adapter cable-side low-resistance network and the adapter cable-side type-C plug shell in the intermediate low-resistance network in parallel to the GND by controlling a third switch switching circuit on the adapter cable side.

An audio signal processing method provided according to an embodiment of the present disclosure includes the following steps.

After an adapter cable is connected to a mobile terminal, it is detected whether a third control instruction used by the mobile terminal to control a third switch switching circuit is received.

When it is detected that the third control instruction used by the mobile terminal to control the third switch switching circuit is received, the adapter cable connects an adapter cable-side low-resistance network and an adapter cable-side type-C plug shell in an intermediate low-resistance network in parallel to a GND.

Figure 2:
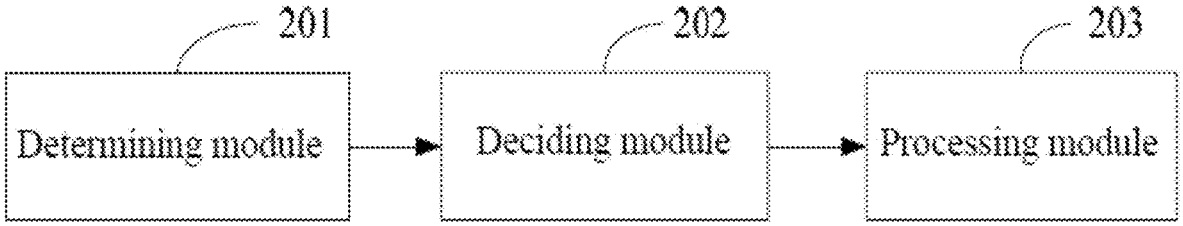
FIG. 2 is a schematic diagram of an audio signal processing device according to an embodiment of the present disclosure.

FIG. 2 is a schematic diagram of an audio signal processing device provided by an embodiment of the present disclosure. As shown in FIG. 2, the audio signal processing device includes a determining module 201, a deciding module 202, and a processing module 203. Specifically, the determining module 201 is configured to determine, when it is detected that a 3.5 mm earphone is connected by means of a type-C plug of an adapter cable, whether states of audio channels of an audio ground (GND) and a microphone (MIC) of the type-C plug are correct. The deciding module 202 is configured to decide whether to enter an audio mode when it is determined that the states of the audio channels of the GND and the MIC of the type-C plug are correct. The processing module 203 is configured to control a low-resistance network for reducing channel impedance to connect in parallel to the GND when it is decided to enter the audio mode.

The determining module 201 includes: a detecting unit, which is configured to detect impedance of the GND and the MIC of the type-C plug through an audio ground signal line SBU1 and a microphone signal line SBU2, so as to decide whether the impedance of the GND and the MIC of the type-C plug meets a preset impedance value; a determining unit, which is configured to determine that the states of the audio channels of the GND and the MIC of the type-C plug are correct when it is decided that the impedance of the GND and the MIC of the type-C plug meets the preset impedance value, and to determine that the states of the audio channels of the GND and the MIC of the type-C plug are wrong when it is decided that the impedance of the GND and the MIC of the type-C plug do not meet the preset impedance value.

The present embodiment further includes a switching module, which is configured to generate a first switching instruction for controlling the type-C plug when it is determined that the states of the audio channels of the GND and the MIC of the type-C plug are wrong, and to switch, according to the first switching instruction, the GND and the MIC of the type-C plug by controlling a first switch switching circuit, so that the impedance of the GND and the impedance of the MIC of the type-C plug meet the preset impedance values.

The low-resistance network includes: a terminal-side low-resistance network, an intermediate low-resistance network, and an adapter cable-side low-resistance network. The terminal-side low-resistance network is an ultra-wide trace on a printed circuit board on a terminal side or a low-resistance wire with a low resistivity and a large diameter on the terminal side. The intermediate low-resistance network is a terminal-side type-C socket shell and an adapter cable-side type-C plug shell. The adapter cable-side low-resistance network is an ultra-wide trace on a printed circuit board on an adapter cable side or is a low-resistance wire with a low resistivity and a large diameter on the adapter cable side.

The processing module 203 includes: a generating unit, which is configured to generate a second control instruction for controlling the terminal side and a third control instruction for controlling the adapter cable side respectively when it is decided to enter the audio mode; a processing unit, which is configured to connect, according to the second control instruction, the terminal-side low-resistance network and the terminal-side type-C socket shell in the intermediate low-resistance network in parallel to the GND by controlling a second switch switching circuit on the terminal side, and to meanwhile connect, according to the third control instruction, the adapter cable-side low-resistance network and the adapter cable-side type-C plug shell in the intermediate low-resistance network in parallel to the GND by controlling a third switch switching circuit on the adapter cable side.

An audio signal processing device provided according to an embodiment of the present disclosure includes a detecting module and a control module.

The detecting module is configured to detect, after the mobile phone is connected, whether a third control instruction used by the mobile terminal to control a third switch switching circuit is received.

The control module is configured to connect an adapter cable-side low-resistance network and an adapter cable-side type-C plug shell in an intermediate low-resistance network in parallel to a GND when it is detected that the third control instruction used by the mobile terminal to control the third switch switching circuit is received.

An audio signal processing apparatus provided by an embodiment of the present disclosure includes a processor and a memory coupled to the processor. The memory stores thereon an audio signal processing program executable by the processor. When executed by the processor, the audio signal processing program implements steps of the audio signal processing methods according to the embodiments of the present disclosure.

A computer storage medium provided by an embodiment of the present disclosure stores an audio signal processing program. When executed by a processor, the audio signal processing program implements steps of the audio signal processing methods according to the embodiments of the present disclosure.

In the embodiments of the present disclosure, three switch switching circuits and a new low-resistance network for reducing the channel impedance are added. Among them, switch switching circuit 1 is used to recognize AGND and MIC networks to ensure correctness of the audio channel. That is, switch switching circuit 1 is used to establish correct correspondence relationships from SBU1 and SBU2 to the GND or the MIC based on the detection by the codec. This is the so-called switching of plug-in orientations into type-C. At the same time, the SBU that corresponds to the GND needs to have impedance as small as possible to the GND, which is also part of functions of switch switching circuit 1. Switch switching circuit 2 is a control switch for incorporating the terminal side into the low-resistance network. Switch switching circuit 3 is a control switch for incorporating the adapter cable side into the low-resistance network. In other words, switch switching circuit 2 and switch switching circuit 3 are used to connect the low-resistance network for reducing the channel impedance in parallel to a signal network in the SBU1 or SBU2. These portions exist on the adapter cable and the mobile phone or the terminal. As shown in FIG. 3, the new low-resistance network for reducing the channel impedance consists of three portions. The first portion is a terminal-side low-resistance network line, which may be implemented as an ultra-wide trace on a printed circuit board or as a low-resistance wire with a low resistivity and a large diameter, connected between switch switching circuit 2 and the type-C socket shell. The second portion is the intermediate low-resistance network, which may be the type-C socket shell and the plug shell of the adapter cable, which two shells are in close contact with each other to reduce contact impedance introduced by the connector. The third portion is an adapter cable-side low-resistance network line, which may be implemented as an ultra-wide trace on a printed circuit board or as a low-resistance wire with a low resistivity and a large diameter, connected between switch switching circuit 3 and the type-C plug shell of the adapter cable.

A key circuit for reducing AGND channel impedance includes the following four portions.

1) The audio codec chip (codec) detects the impedance of the MIC and the GND of the earphone by means of SBU1 and SBU2, and realizes the switching of plug-in orientations into type-C by means of switch switching circuit 1 to ensure that the states of the channels of the audio GND and the MIC are correct.

2) The type-C plug shell and the type-C socket shell, as part of the low-resistance network for reducing the channel impedance, can greatly reduce contact impedance of the connectors (the type-C plug shell and the type-C socket shell).

The type-C plug shell and the type-C socket shell are connected to the low-resistance network of the adapter cable for reducing the channel impedance. Due to large external surface areas of the type-C plug shell and the type-C socket shell, the relatively large impedance and contact impedance of a SBU1 or SBU2 pin in the type-C physical interface are changed. After the type-C plug shell and the type-C socket shell are incorporated as SBU1 or SBU2 into a part of the low-resistance network channel, entire channel impedance of SBU1 or SBU2 can be greatly reduced. These portions exist on the adapter cable and the mobile phone or the terminal. The type-C plug shell and the type-C socket shell are bridges connecting the mobile phone-side ultra-wide low-impedance network and the adapter cable-side ultra-wide low-impedance network. Transition and connection between the two low-resistance networks are realized through a large-area contact between the type-C plug shell and the type-C socket shell.

3) The ultra-wide low-resistance network on the adapter cable can greatly reduce conductor impedance of the trace on the printed circuit board.

4) After the detection of MIC and AGND signals is completed, the low-resistance network for reducing the channel impedance is connected in parallel to the AGND by controlling the switch switching circuit 2 and the switch switching circuit 3, so as to realize the purpose of reducing the channel impedance on the mobile terminal.

In summary, the above four portions jointly fulfill the goal of reducing common ground impedance of left and right channels of the earphone, and finally completely improve the indicator of crosstalk without sacrificing the capability of recognizing earphones and the noise reduction effect.

The technology of the present disclosure will be explained below with reference to embodiments of FIGS. 4 to 7.

When a first-type earphone is a European standard earphone, a second-type earphone is an American standard earphone. When the first-type earphone is an American standard earphone, the second-type earphone is a European standard earphone. The two types of earphones may be interchanged.

Figure 4:
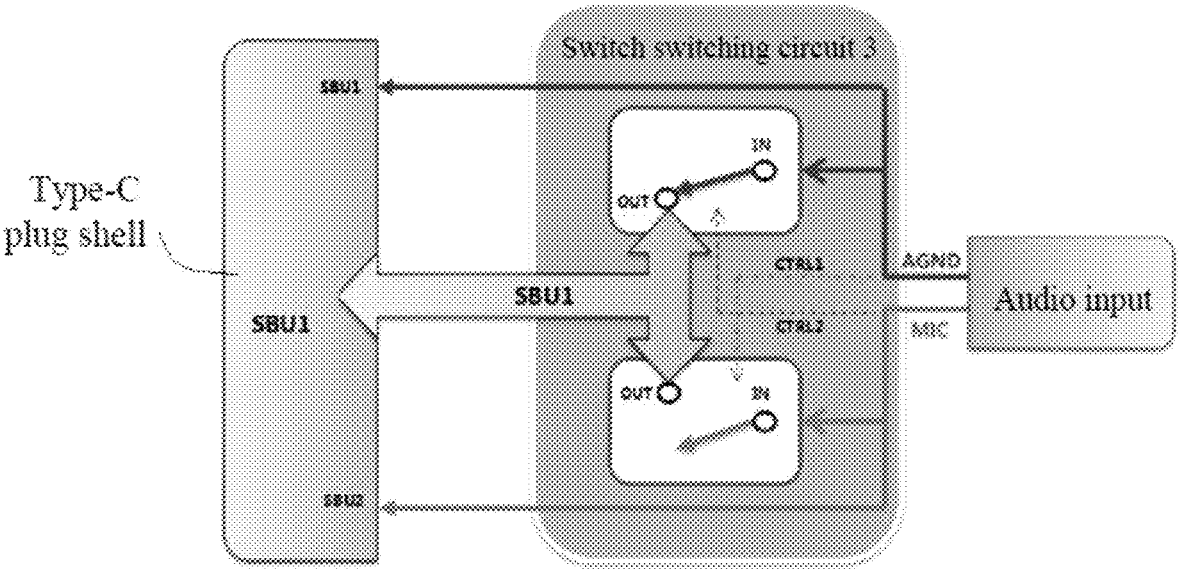
FIG. 4 is a block diagram of a circuit of an adapter cable part of a first-type earphone and a schematic diagram showing a state of its switch switching circuit according to an embodiment of the present disclosure.
Figure 5:
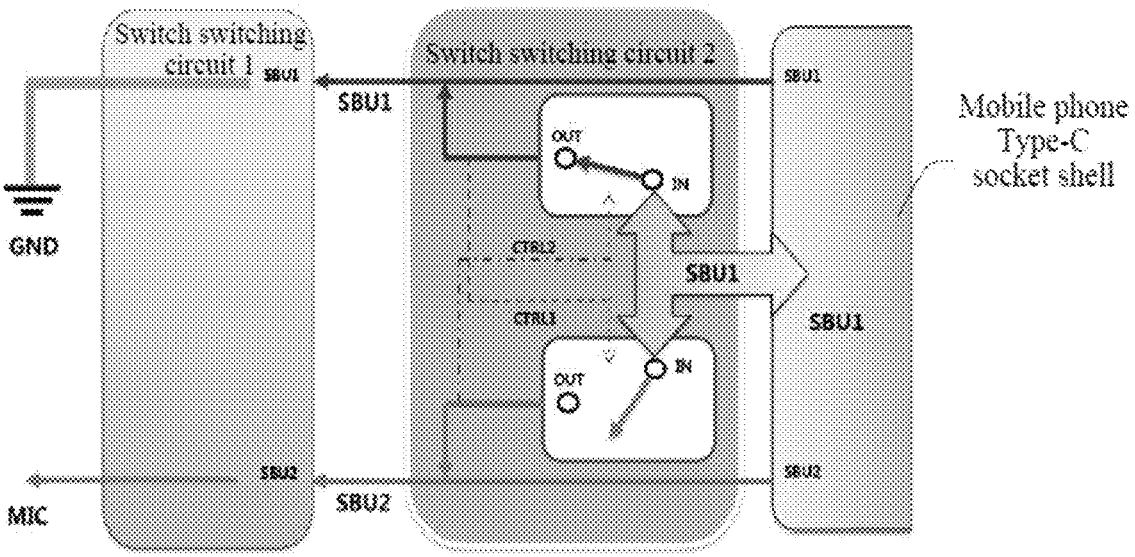
FIG. 5 is a block diagram of a circuit of a terminal part of the first-type earphone and a schematic diagram showing a state of its switch switching circuit according to the embodiment of the present disclosure.

As shown in FIGS. 4 and 5, when SUB1=AGND and SUB2=MIC, the MIC channel is open, in which case an MIC signal has a bias voltage which is a high level. Because CTRL2=1, a switch at the upper half of switch switching circuit 2 is incorporated into the low-resistance network. Because CTRL1=0, a switch at the lower half of switch switching circuit 2 is open. Similarly, because CTRL2=1, an upper half switch of switch switching circuit 3 is incorporated into the low-resistance network. Because CTRL1=0, a lower half switch of switch switching circuit 3 is open. In other words, after correspondence relationships from SUB1 and SUB2 to the AGND and the MIC are determined, since the MIC channel is open, there is a bias voltage on the MIC signal. Switch switching circuit 2 and switch switching circuit 3 are thus correctly controlled by using this bias voltage, enabling the ultra-wide low impedance network to be connected to the AGND side.

Figure 6:
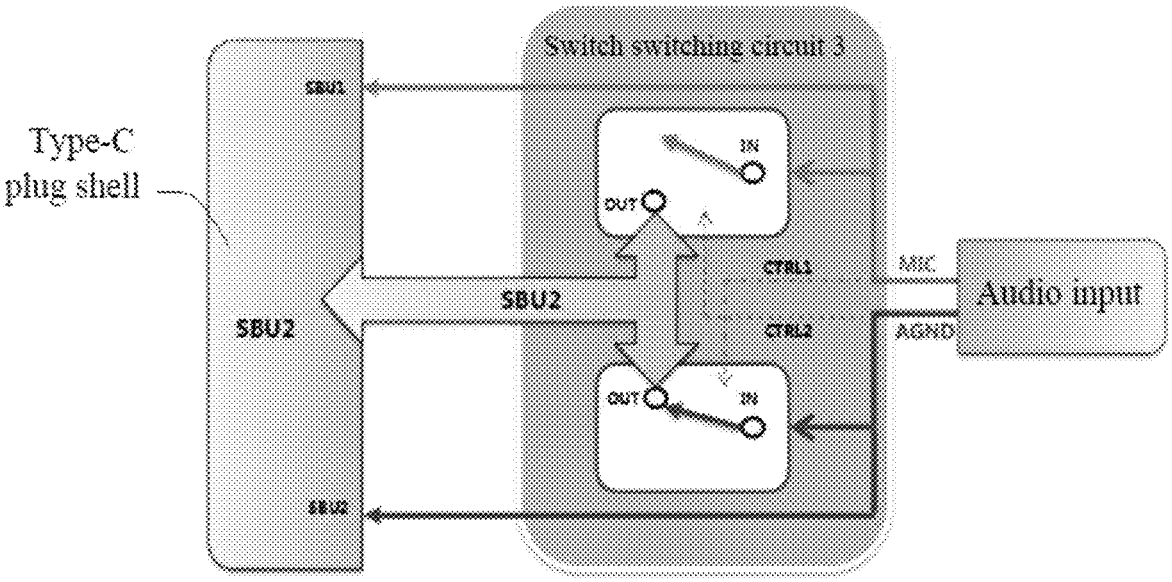
FIG. 6 is a block diagram of a circuit of an adapter cable part of a second-type earphone and a schematic diagram showing a state of its switch switching circuit according to an embodiment of the present disclosure.
Figure 7:
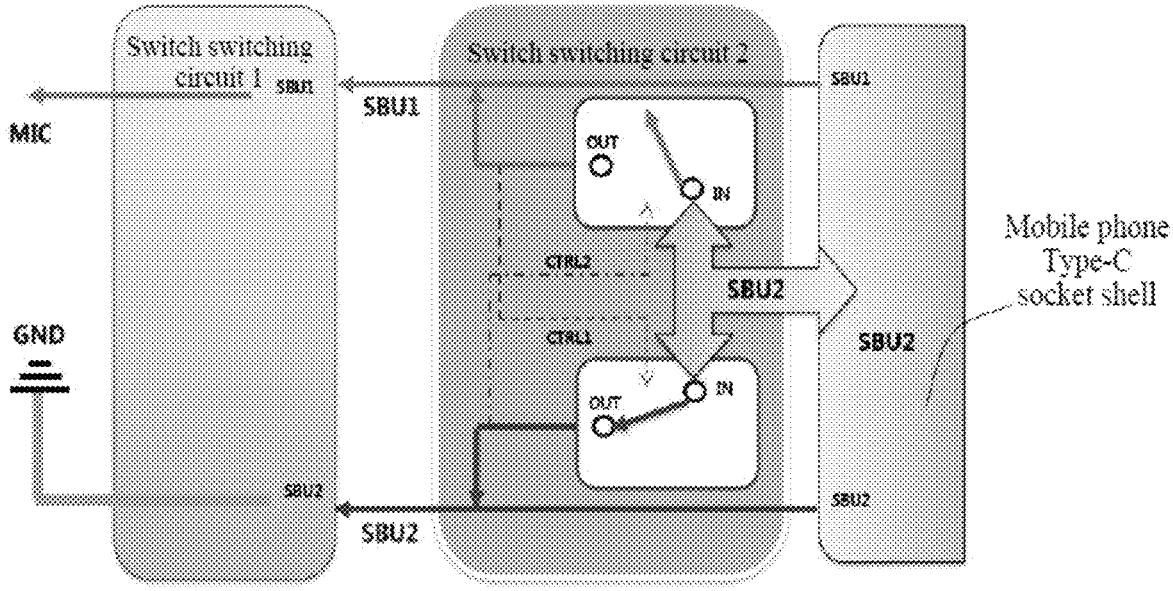
FIG. 7 is a block diagram of a circuit of a terminal part of the second-type earphone and a schematic diagram showing a state of its switch switching circuit according to the embodiment of the present disclosure.

As shown in FIGS. 6 and 7, when SUB1=MIC and SUB2=AGND, the MIC channel is open, in which case the MIC signal has a bias voltage which is a high level. Because CTRL1=1, a switch at the lower half of switch switching circuit 2 is incorporated into the low-resistance network. Because CTRL2=0, a switch at the upper half of switch switching circuit 2 is open. Similarly, because CTRL1=1, a switch at the lower half of switch switching circuit 3 is incorporated into the low-resistance network. Because CTRL2=0, a switch at the upper half of the switch switching circuit 3 is open.

Figure 8:
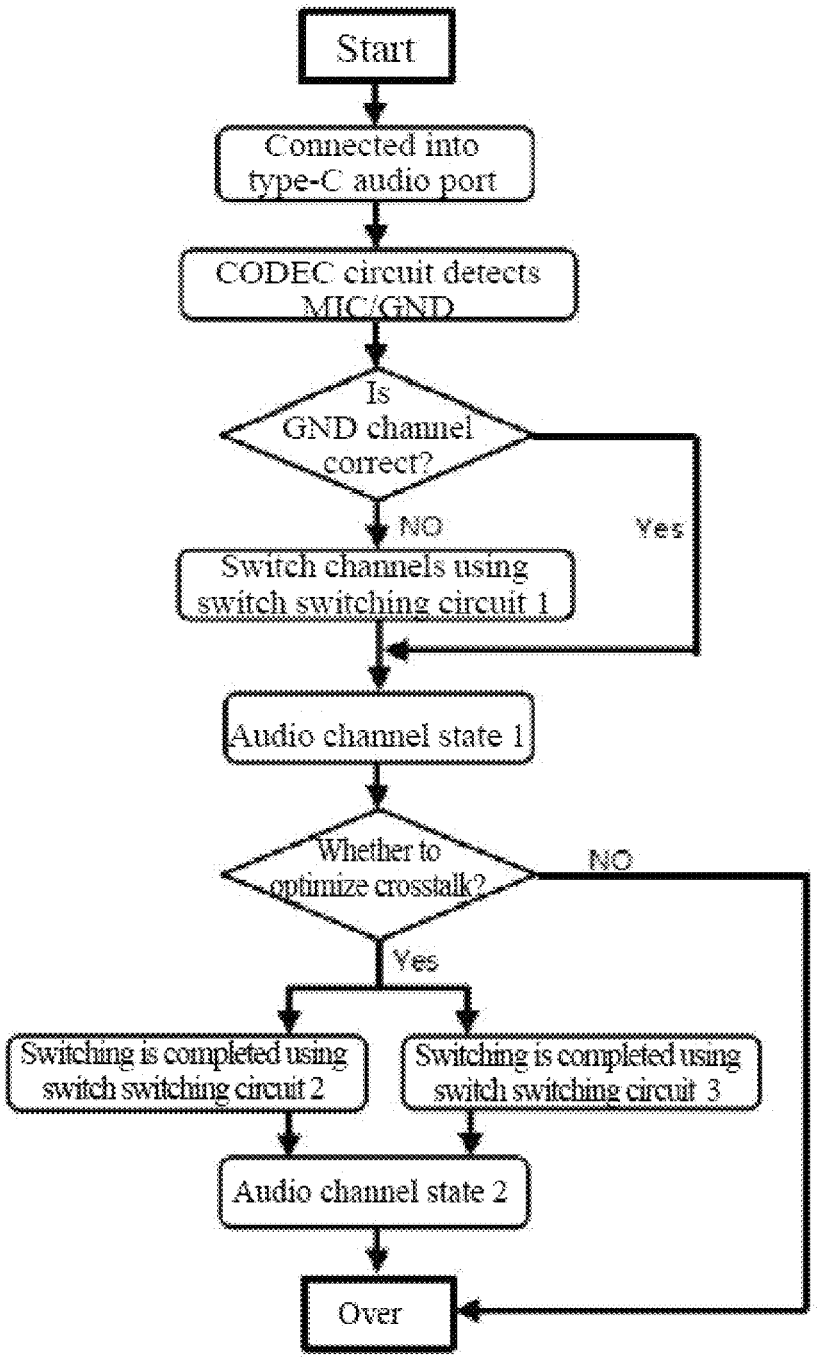
FIG. 8 is a working flowchart of an audio signal processing circuit provided by an embodiment of the present disclosure.

FIG. 8 is a working flowchart of an audio signal processing circuit provided by an embodiment of the present disclosure. As shown in FIG. 8, the working flow of the circuit is described as follows.

In step 1, after the adapter cable is connected to the 3.5 mm earphone, the type-C plug of the adapter cable is inserted into the mobile phone or terminal.

In step 2, an internal circuit (a general purpose circuit) of the codec detects impedance to ground of SBU1 and SBU2 respectively.

In step 3, it is determined whether the GND channel is correct.

It is determined whether the impedance of SBU1 or SBU2 corresponds to the MIC or the GND. If the impedance of SBU1 or SBU2 does not correspond to the MIC or the GND, a cross switching is performed using switch switching circuit 1. Switching between European standard earphone and American standard earphone is performed to realize the audio channel state 1. If the impedance of SBU1 or SBU2 corresponds to the MIC or the GND, switch switching circuit 1 remains unchanged. Switching between European standard earphone and American standard earphone is performed to realize audio channel state 1.

In step 4, it is determined whether to optimize crosstalk.

It is determined whether to enable the mobile phone or terminal to enter the audio mode. If it is determined to enable the mobile phone or terminal to enter the audio mode, switch switching circuit 2 and switch switching circuit 3 are controlled to incorporate the AGND represented by SBU1 or SBU2 into the low-resistance network. The crosstalk indicator is optimized to realize audio channel state 2. Circuit control is then ended. If it is determined not to enable the mobile phone or terminal to enter the audio mode, no operation is performed on switch switching circuit 2 and switch switching circuit 3, and audio channel state 1 is maintained.

The solutions provided by the embodiments of the present disclosure alleviate and solve the crosstalk problem by reducing the impedance of the GND network, and are highly compatible. The definition of the type-C interface remains unchanged, and there is no change to the audio codec chip. This not only provides compatibility with common earphone communications and detection methods, but also optimizes crosstalk performance.

Although the present disclosure is described in detail above, the present disclosure is not limited thereto. Those skilled in the art may make various modifications in accordance with the principles of the present disclosure. All modifications made in accordance with the principles of the present disclosure shall be interpreted as falling within the protection scope of the present disclosure.

The invention claimed is:

1. An audio signal processing method comprising:

determining, by a mobile terminal, when detecting that a 3.5 mm earphone is connected by means of a type-C plug of an adapter cable, whether states of audio channels of an audio ground GND and a microphone MIC of the type-C plug are correct;

deciding, by the mobile terminal, when determining that the states of the audio channels of the GND and the MIC of the type-C plug are correct, whether to enter an audio mode; and controlling a low-resistance network for reducing channel impedance to connect in parallel to the GND if the mobile terminal decides to enter the audio mode;

wherein the low-resistance network comprises a terminal-side low-resistance network, an intermediate low-resistance network, and an adapter cable-side low-resistance network, wherein the terminal-side low-resistance network is a trace on a printed circuit board on a terminal side with a wider width relative to a type-C interface signal line, or a low-resistance wire on the terminal side with a lower resistivity and a larger diameter relative to the type-C interface signal line;

the intermediate low-resistance network comprises a terminal-side type-C socket shell and an adapter cable-side type-C plug shell; and the adapter cable-side low-resistance network is a trace on a printed circuit board on an adapter cable side with a wider width relative to the type-C interface signal line or a low-resistance wire on the adapter cable side with a lower resistivity and a larger diameter relative to the type-C interface signal line.

2. The method according to claim 1, further comprising:

generating a first switching instruction for controlling the type-C plug when the mobile terminal determines that the states of the audio channels of the GND and the MIC of the type-C plug are wrong; and switching, by the mobile terminal, according to the first switching instruction, the GND and the MIC of the type-C plug by controlling a first switch switching circuit, so that the impedance of the GND and the impedance of the MIC of the type-C plug meet preset impedance values.

3. The method according to claim 1, wherein controlling the low-resistance network for reducing the channel impedance to connect in parallel to the GND if the mobile terminal decides to enter the audio mode comprises:

generating a second control instruction for controlling the terminal side and a third control instruction for controlling the adapter cable side respectively when the mobile terminal decides to enter the audio mode; and connecting, by the mobile terminal, according to the second control instruction, the terminal-side low-resistance network and the terminal-side type-C socket shell in the intermediate low-resistance network in parallel to the GND by controlling a second switch switching circuit on the terminal side, and meanwhile connecting, according to the third control instruction, the adapter cable-side low-resistance network and the adapter cable-side type-C plug shell in the intermediate low-resistance network in parallel to the GND by controlling a third switch switching circuit on the adapter cable side.

4. An audio signal processing method comprising:

detecting, after an adapter cable is connected to a mobile terminal, whether a third control instruction used by the mobile terminal to control a third switch switching circuit is received; and connecting, by the adapter cable, an adapter cable-side low-resistance network and an adapter cable-side type-C plug shell in an intermediate low-resistance network in parallel to a GND when it is detected that the third control instruction used by the mobile terminal to control the third switch switching circuit is received;

wherein the intermediate low-resistance network and the adapter cable-side low-resistance network are comprised in a low-resistance network, and the low-resistance network further comprises a terminal-side low-resistance network;

wherein the terminal-side low-resistance network is a trace on a printed circuit board on a terminal side with a wider width relative to a type-C interface signal line, or a low-resistance wire on the terminal side with a lower resistivity and a larger diameter relative to the type-C interface signal line;

wherein the intermediate low-resistance network comprises a terminal-side type-C socket shell and an adapter cable-side type-C plug shell; and wherein the adapter cable-side low-resistance network is a trace on a printed circuit board on an adapter cable side with a wider width relative to the type-C interface signal line or a low-resistance wire on the adapter cable side with a lower resistivity and a larger diameter relative to the type-C interface signal line.

5. An audio signal processing apparatus comprising: a processor and a memory coupled to the processor, the memory storing thereon an audio signal processing program executable by the processor, wherein when executed by the processor, the audio signal processing program implements an audio signal processing method comprising:

determining, at a mobile terminal, when detecting that a 3.5 mm earphone is connected by means of a type-C plug of an adapter cable, whether states of audio channels of an audio ground GND and a microphone MIC of the type-C plug are correct;

deciding, at the mobile terminal, when determining that the states of the audio channels of the GND and the MIC of the type-C plug are correct, whether to enter an audio mode; and controlling a low-resistance network for reducing channel impedance to connect in parallel to the GND if the mobile terminal decides to enter the audio mode;

wherein the low-resistance network comprises a terminal-side low-resistance network, an intermediate low-resistance network, and an adapter cable-side low-resistance network, wherein the terminal-side low-resistance network is a trace on a printed circuit board on a terminal side with a wider width relative to a type-C interface signal line, or a low-resistance wire on the terminal side with a lower resistivity and a larger diameter relative to the type-C interface signal line;

the intermediate low-resistance network comprises a terminal-side type-C socket shell and an adapter cable-side type-C plug shell; and the adapter cable-side low-resistance network is a trace on a printed circuit board on an adapter cable side with a wider width relative to the type-C interface signal line or a low-resistance wire on the adapter cable side with a lower resistivity and a larger diameter relative to the type-C interface signal line.

* * * * *